US010193292B2

(12) United States Patent
Onishi

(10) Patent No.: US 10,193,292 B2
(45) Date of Patent: Jan. 29, 2019

(54) JIG AND PRESS-FITTING DEVICE COMPRISING THIS JIG

(71) Applicant: J.S.T. Mfg. Co., Ltd., Osaka-shi (JP)

(72) Inventor: Junji Onishi, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 282 days.

(21) Appl. No.: 14/647,620

(22) PCT Filed: Nov. 27, 2013

(86) PCT No.: PCT/JP2013/081869
§ 371 (c)(1),
(2) Date: May 27, 2015

(87) PCT Pub. No.: WO2014/084240
PCT Pub. Date: Jun. 5, 2014

(65) Prior Publication Data

US 2015/0311660 A1 Oct. 29, 2015

(30) Foreign Application Priority Data

Nov. 30, 2012 (JP) ..... 2012-262220

(51) Int. Cl.
*H01R 43/20* (2006.01)
*H01R 12/61* (2011.01)
(Continued)

(52) U.S. Cl.
CPC ..... *H01R 43/205* (2013.01); *H01R 12/613* (2013.01); *H01R 12/721* (2013.01);
(Continued)

(58) Field of Classification Search
CPC ..... H01R 43/20; H01R 43/205; H01R 43/28; H01R 12/585; H01R 12/613;
(Continued)

(56) References Cited

U.S. PATENT DOCUMENTS 5,092,029 A 3/1992 Fisher et al.
5,568,686 A * 10/1996 Suarez ..... Y10T 29/53217 29/566.3
(Continued)

FOREIGN PATENT DOCUMENTS

JP S64-36994 U 3/1989
JP 2000-260513 9/2000
(Continued)

OTHER PUBLICATIONS

Extended European Search Report dated Jun. 15, 2016 issued with respect to the corresponding European Patent Application No. 13859451.0.
(Continued)

*Primary Examiner* — A. Dexter Tugbang
(74) *Attorney, Agent, or Firm* — Kratz, Quintos & Hanson, LLP

(57) ABSTRACT

Provided are a jig and a press-fitting device that are capable of suppressing buckling during the press-fitting process. The jig has a jig unit in which a plurality of metal plate-shaped bodies for installing a press-fit terminal onto a substrate are combined. The jig unit includes a movable guide member having a guide groove through which a terminal main body can pass; an insertion punch having a punch groove corresponding to the guide groove, and having a pressing section formed therein; and a rear surface plate body. The movable guide member and the rear surface plate body are attached so as to be vertically movable relative to the insertion punch and, while the press-fit section is being press-fitted into the substrate by the insertion punch, the movable guide member and the rear surface plate body move upward relative to the insertion punch after the lower sides thereof abut to the substrate.

8 Claims, 10 Drawing Sheets

(51) Int. Cl.
*H01R 43/28* (2006.01)
*H01R 12/72* (2011.01)
*H01R 12/58* (2011.01)

(52) U.S. Cl.
CPC ..... *H01R 43/20* (2013.01); *H01R 43/28* (2013.01); *H01R 12/585* (2013.01); *H01R 12/724* (2013.01); *Y10T 29/49208* (2015.01); *Y10T 29/49217* (2015.01); *Y10T 29/49222* (2015.01); *Y10T 29/53209* (2015.01); *Y10T 29/53217* (2015.01); *Y10T 29/53252* (2015.01); *Y10T 29/53265* (2015.01)

(58) Field of Classification Search
CPC ..... H01R 12/721; H01R 12/724; Y10T 29/49208; Y10T 29/49217; Y10T 29/49222; Y10T 29/53209; Y10T 29/53252; Y10T 29/53265; Y10T 29/53217
See application file for complete search history.

(56) References Cited

U.S. PATENT DOCUMENTS 6,305,949 B1 10/2001 Okuyama
6,397,457 B1 * 6/2002 Wuyts ..... H01R 43/205 140/147
8,191,242 B1 * 6/2012 Liang ..... Y10T 29/53217 29/749
2004/0005794 A1 1/2004 Yamashita
2004/0175970 A1 9/2004 Shioda
2005/0014424 A1 1/2005 Sakata
2008/0050947 A1 * 2/2008 Nunokawa ..... H01R 12/585 439/82
2009/0035964 A1 2/2009 Yamamoto
2012/0115339 A1 5/2012 Schaarschmidt

FOREIGN PATENT DOCUMENTS

JP 2004-31006 A1 1/2004
JP 2004-319338 A1 11/2004
JP 2005-44788 A1 2/2005
JP 2005-135669 A1 5/2005
JP 2006-331780 A1 12/2006
JP 2008004345 A * 1/2008
JP 2011222399 A * 11/2011
JP 2012-529731 A1 11/2012

OTHER PUBLICATIONS

International Search Report for International Application No. PCT/JP2013/081869 dated Feb. 25, 2014.

* cited by examiner 10
11
12
12a
14
14a
15
18
18a
20
20a
21
26
26a
33
35
38
39
40
44
G
VIB
VIC

JIG AND PRESS-FITTING DEVICE COMPRISING THIS JIG

TECHNICAL FIELD

This invention relates to a jig and a press-fitting device for installing press-fit terminals having press-fit sections to a member to be installed. More precisely, this invention relates to a jig and a press-fitting device being provided with the jig which can suppress the occurrence of the buckling of the press-fit sections of the press-fit terminals due to the pressing toward the member to be installed during the installation process.

BACKGROUND ART

In order to install the press-fit terminals which have press-fit sections to the member to be installed such as a substrate, a specific jig has been used heretofore. This jig can press the press-fit terminals to fit into the through-holes formed on the substrate by pressing the shoulders for being pressed and formed on one part of the press-fit terminals. In this moment, the press-fit terminals, since they have a long length, are buckled and damaged at the middle thereof when the pressing force is applied. Therefore, the buckling of the press-fit terminals need to be restricted when the press-fit terminals are press-fitted. In order to solve such problem, Japanese Laid-Open Patent Publication No. 2006-331780A discloses an invention of a press-fit jig capable of ensuring that the bucking of the press-fit contacts can be prevented when they are press-fitted.

The press-fit jig disclosed in Japanese Laid-Open Patent Publication No. 2006-331780A includes a jig main body and a jig for correcting a posture; wherein the jig main body is provided with aligned teeth aligned and arranged in one or plurality of lows in the right and left direction so as to form a comb-teeth shape and vertically disposed on the base of upper portion, and protruded portions which are protruded frontward or backward on the one side of the wall surface of the aligned teeth in the front and rear direction, and whose lower surface constitutes a pressing surface for downwardly pressing the shoulders of the upper surfaces of the press-fit contacts; and the jig for correcting a posture has a correcting portion of comb-teeth shape which forces to press one side of the wall surface in the front and rear direction of the shoulders toward front or rear so that the upper surface of the shoulders of the press-fit contacts are positioned on the lower surface of the protruded portions, and linearly corrects the distal ends of the press-fit contacts lower than the shoulders being parallel along with the press-fit direction.

With such a configuration, according to the press-fit jig disclosed in Japanese Laid-Open Patent Publication No. 2006-331780A, the distal ends of the press-fit contacts which are inclined toward the front or rear with respect to the press-fit direction and are not aligned are linearly aligned by the jig main body, thus when the press-fit jig is pressed by the press-fitting device to fit the press-fit contacts into the substrate, the press-fit contacts are effectively press-fitted without buckling and frequent interruptions of the press-fit process, and the yield of the press-fit contacts are enhanced.

PRIOR ART DOCUMENTS

Patent Documents

According to the press-fit jig disclosed by Japanese Laid-Open Patent Publication No. 2006-331780A, it is possible to correct the position with respect to the positions of holes on the printed circuit board by aligning the distal portions of the press-fit contacts. However, since the press-fit sections are not guided during the insertion into the holes of the substrate, there exists a problem of buckling occurring at the press-fit sections.

This invention is to solve the such problem of the prior art, and aims to provide a jig and a press-fit device being provided with the jig which jig is for pressing a connector including press-fit terminals with press-fit sections to fit into and to install on a member to be installed such as a substrate or a contact housing and which jig includes insertion punches for pressing the shoulders formed on the press-fit terminals and movable guide members for alignment by guiding the press-fit sections and the distal portion side thereof and being capable of upward and downward movement during the press-fit process; thereby buckling at the press-fit sections and the distal portions thereof can be restricted.

Means for Solving the Problem

In order to solve the above problem, a jig of one aspect of the present invention includes a jig unit for installing a plurality of press-fit terminals which have shoulders and press-fit sections being formed wider than a width of a terminal main body and are arranged in at least one row, the jig unit being assembled by a plurality of plate-shaped bodies made of metal, the jig unit including:

at least one sheet of movable guide member being formed in a comb-teeth shape having a plurality of guide grooves into which the terminal main bodies can be fitted; at least one sheet of insertion punch being formed in a comb-teeth shape having a plurality of punch grooves corresponding to the guide grooves and being formed with pressing sections at the punch grooves for pressing the shoulders; and one sheet of rear surface plate body; wherein the movable guide member and the rear surface plate body are attached so as to be upwardly and downwardly movable with respect to the insertion punch; and when the press-fit terminals are installed to the member to be installed, and during the press-fit sections being press fitted to the member to be installed by the insertion punch, the movable guide member and the rear surface plate body move upward with respect to the insertion punch after the lower ends of the movable guide member and the insertion punch abut to the member to be installed.

A jig of another aspect of the present invention features that, in the jig of first aspect, the jig unit is assembled so that the movable guide members and the insertion punches are alternatively disposed wherein the movable guide member is disposed at the side from which the press-fit terminals are inserted while the rear surface plate body is disposed at the opposite side to the side from which the press-fit terminals are inserted; and the position of lower ends of the insertion punches are placed above with respect to lower ends of the movable guide members and the rear surface plated body.

A jig of another aspect of the present invention features that, in the jig of second aspect, the movable guide member is formed with at least one first movable opening of oval shape at an upper portion thereof and at least one first fixing hole at a lower portion thereof;

the insertion punch is formed with at least one second fixing hole at an upper portion thereof and at least one second movable opening of oval shape at a lower portion thereof;

the plate main body is formed with at least one third movable opening of oval shape at an upper portion thereof and at least one third fixing hole at a lower portion thereof;

the first movable opening, the second fixing hole, and the third movable opening are inserted with one identical fixing member while the first fixing hole, the second movable hole, and the third fixing hole are inserted with one identical fixing member.

A jig of another aspect of the present invention features that, in the jig of any of first through third aspects, an elastic member for downwardly pressing the movable guide member and the rear surface plate body is provided on upper side of the jig unit.

A jig of another aspect of the present invention features that, in the jig of any of first through third aspects, when the jig unit is attached with the press-fit terminals, at least one portion of the terminal main body is inserted to the jig unit from the side where the movable guide member is placed at the outside, an upper portion of the terminal main body upper than the shoulders is inserted through the guide groove of the movable guide member and through the punch groove of the insertion punch at least one portion of the terminal main body upper than the shoulders is placed inside the punch groove when the press fit terminals being provided on the outermost side abut to the rear surface plate body; and by moving the jig unit downward, the both side surfaces of the terminal main body in the widthwise direction of which the press-fit terminals being arranged are guided by the punch groove, the pressing section abuts against the upper portion of the shoulders, the shoulders of the press-fit terminal to which the comb-teeth portion being provided on both sides of the guide groove of the movable guide member abuts, a portion of the press-fit section formed in being wider than the guide groove, and a portion of the press-fit terminal to which the rear surface plate body abut are guided.

A jig of another aspect of the present invention features that, in the jig of fifth aspect, when the jig unit is moved downward and the press-fit terminals are press-fitted to the member to be installed, the downward movement of the movable guide member and the rear surface plate body is restricted by the abutment of the lower ends of the movable guide member and the rear surface plate body against the member to be installed, thereafter, by continually moving the jig unit downward, the insertion punch is moved downward and the shoulders are pressed by the pressing section thereby the press-fit section is press-fitted to the member to be installed, and the shoulders and a portion formed in being wider than the guide groove and a portion to which the rear surface plate body abuts, of the press-fit section, are guided by the comb-teeth portion of the movable guide member.

A jig of another aspect of the present invention features that, in the jig of sixth aspect, the upper portion of the jig unit is provided with an elastic member, the elastic member is elastically deformed by the upward relative movement of the movable guide member and the rear surface plate body with respect to the insertion punches when the jig unit is moved downward, and after the completion of the installation of the press-fit terminals to the member to be installed and when the jig unit is moved upward, the elastic deformation of the elastic member is released and the movable guide member and the rear surface plate body are pressed downward by the elastic force of the elastic member, thereby the movable guide member and the rear surface plate body are placed at a predetermined position.

A press-fitting device of the present invention to be provided with the jig of any of first through seventh aspects.

Advantageous Effect of Invention

In the jig of one aspect of the present invention, when the press-fit terminals are installed to the member to be installed, the movable guide member and the rear surface plate body abut to the member to be installed and thereafter they move upward with respect to the insertion punch. Therefore, according to the jig of the first aspect, the buckling of the time during the press-fit process of the press-fit terminals can be restricted since the press-fit terminals are press-fitted to the member to be installed by being pressed with the insertion punch at the shoulders thereof, and during the press-fit terminals are press-fitted to the member to be installed, the movable guide member and the rear surface plate body move upward with respect to the insertion punch and guide the shoulders of the press-fit terminals and the portions of the press-fit terminals extending out from the guide grooves of the movable guide member by the portion of the comb-teeth shape. Further, even if the number of rows of the press-fit terminals increases, the number of the movable guide members and the insertion punches can be increased, thus a variety of press-fit terminals can be installed by making use of one jig.

It is also possible that shoulder receiving grooves to which the shoulders of the press-fit terminals formed as being wider than the width of the punch grooves are inserted are formed in the punch grooves of the insertion punch and thus the upper portion of the shoulder receiving grooves are formed as pressing sections. In this way, the side surfaces of the shoulders of the press-fit terminals are supported by the shoulder receiving grooves, thereby the shoulders can be vertically and uprightly inserted when the pressing sections of the shoulders are pressed during the insertion of the press-fit terminals into member to be installed. The shoulder receiving grooves are formed with tapers which are gradually widened toward the lower side with respect to the shoulder receiving grooves at the lower side of the shoulder receiving grooves, thus the shoulders are easily inserted to the shoulder receiving grooves, and the damage of shoulders can be restricted.

According to the jig of the another aspect of the present invention, since the movable guide member and the rear surface plate body which guide the press-fit terminals can move upward and downward with respect to the insertion punch which presses the press-fit terminals, the different actions are implemented with the pressing section and the guiding section in the one jig unit, thereby the jig which can implement variety of insertions can be provided. Further, even if the number of alignments of the press-fit terminals increases, the number of the movable guide members and the insertion punches can be increased, thus a variety of press-fit terminals can be installed by making use of one unit.

Further, according to the jig of the another aspect of the present invention, since the position where the insertion punch of the jig unit is placed is upper than the position where the movable guide member and the rear surface plate body are placed, the movable guide member and the rear surface plate body abutting to the member to be installed earlier than insertion punch abuts to the member to be installed. As the insertion punch moves downward and presses the shoulders, and the press-fit terminals are press-fitted to the member to be installed, the movable guide member and the rear surface plate body which are pressed by the member to be installed move upward with respect to the insertion punch. Therefore, the buckling of the press-fit terminals can be restricted since the press-fit terminals are guided during the upward movement of the movable guide member and the rear surface plate body.

Further, according to the jig of the another aspect of the present invention, the movable guide member and the rear surface plate body are fixed with respect to the insertion punch, and the fixing members such as bolts each of which penetrates through the first and the third movable openings which are formed in oval shape and the second fixing holes; and through the first and the third fixing holes and the second movable openings move, thereby the movable guide member and the rear surface plate body can be move upward and downward with respect to the insertion punch by the dimensions of the oval shape.

Further, according to the jig of the another aspect of the present invention, the movable guide member and the rear surface plate body which have been moved upward in order for installing the press-fit terminals can be pressed downward and be placed at the predetermined position, thus the installation of the press-fit terminals can be repeatedly and continuously implemented. Further, when the jig is in an initial placement, the movable guide member and the rear surface plate body are pressed downward by the elastic member, thus a gap can be formed under the insertion punch.

Further, according to the jig of the another aspect of the present invention, in the process for attaching the press-fit terminals to the jig unit, when the press-fit terminals are inserted through the guide grooves and the punch grooves which are disposed in parallel, the press-fit terminals can be aligned in vertical with respect to the member to be installed. Further, according to the jig of this aspect of the present invention, when the press-fit terminals are inserted to the jig unit, the movable guide member and the rear surface plate body guide the press-fit sections and the shoulders of the press-fit terminals from the front and rear direction, thus the deviation in the front and rear direction of the press-fit terminals can be adjusted. It is also possible that shoulder receiving grooves to which the shoulders of the press-fit terminals formed as being wider than the width of the punch grooves are inserted are formed in the punch grooves of the insertion punch and thus the upper portion of the shoulder receiving grooves are formed as pressing sections. In this way, the side surfaces of the shoulders of the press-fit terminals are supported by the shoulder receiving grooves, thereby the shoulders can be vertically and uprightly inserted when the pressing sections of the shoulders are pressed during the insertion of the press-fit terminals into member to be installed. The shoulder receiving grooves are formed with tapers which are gradually widened toward the lower side with respect to the shoulder receiving grooves at the lower side of the shoulder receiving grooves, thus the shoulders are easily inserted to the shoulder receiving grooves, and the damage of shoulders can be restricted.

Further, according to the jig of the another aspect of the present invention, when the press-fit terminals are installed to the member to be installed, the movable guide member and the rear surface body can guide the press-fit sections and the shoulders of the press-fit terminals from the front and rear direction and move upward and downward to guide them, during the installation, until the completion of the installation, thus the buckling of the distal portions directed from the press-fit sections can be restricted.

Further, according to the jig of the another aspect of the present invention, by providing the elastic member to the jig, the movements of the movable guide member and the rear surface plate body can be continuously implemented, thus the installation of the press-fit terminals to the member to be installed can be repeatedly implemented.

Further, according to the press-fitting device of the present invention, the press-fitting device which exhibits the effects of the jig of above aspects can be obtained.

EXEMPLARY EMBODIMENT OF THE INVENTION

Figure 1:
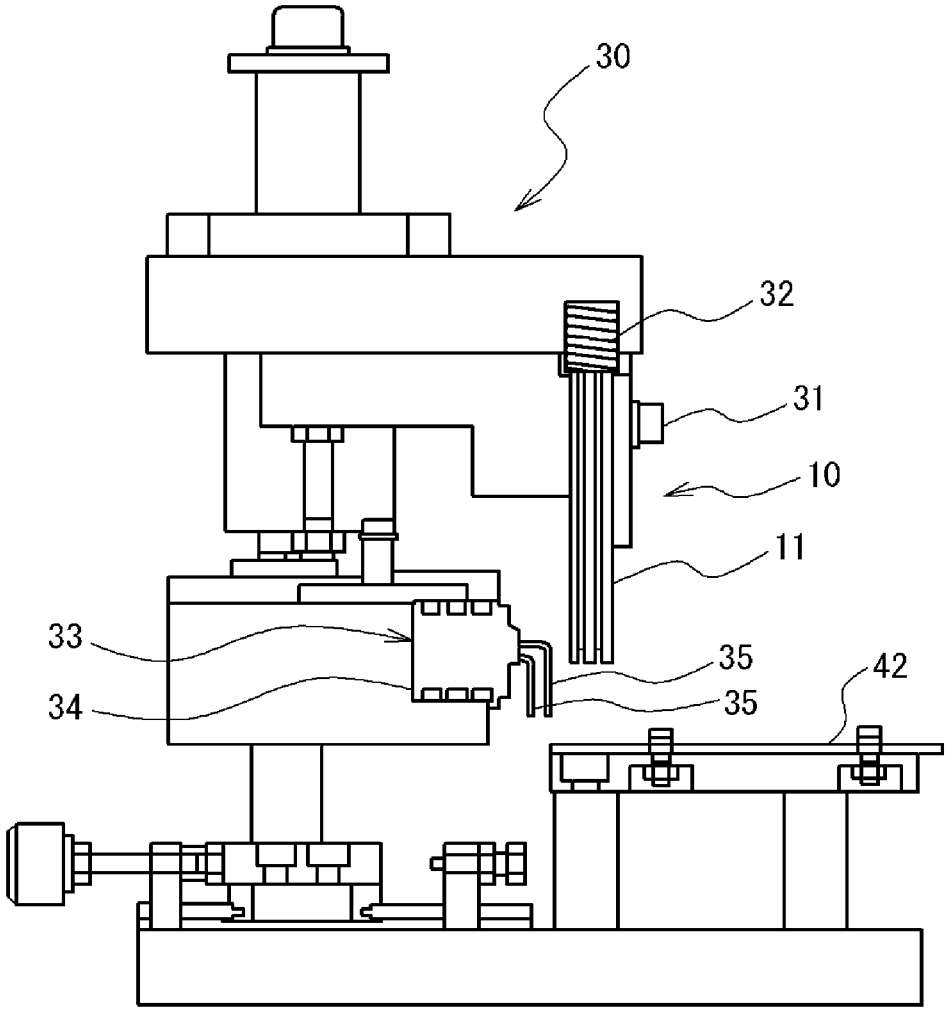
FIG. 1 shows a cross-sectional view of a press-fitting device being provided with a jig of one embodiment.
Figure 2A:
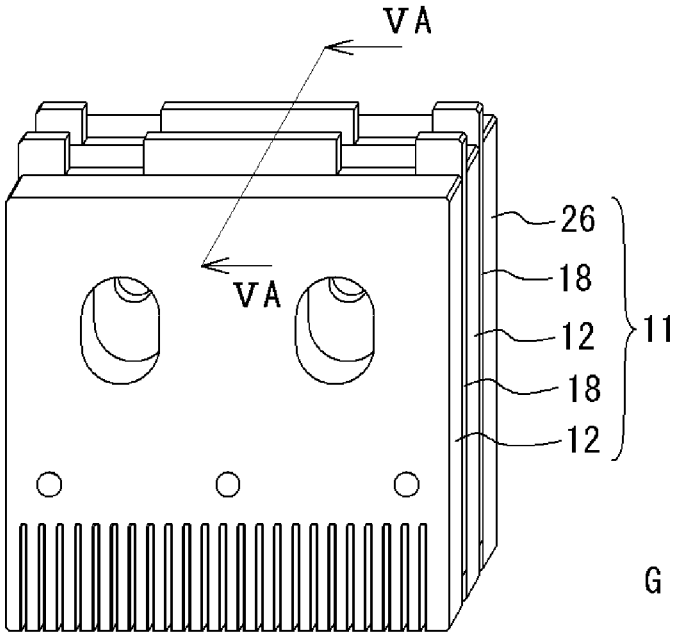
FIG. 2A shows a perspective view of the jig unit constituting the jig of the embodiment.
Figure 2B:
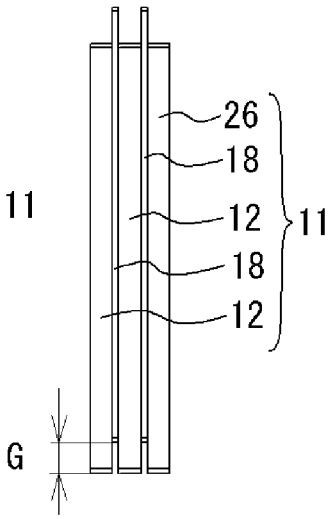
FIG. 2B shows a side view of the jig unit of FIG. 2A.
Figure 2C:
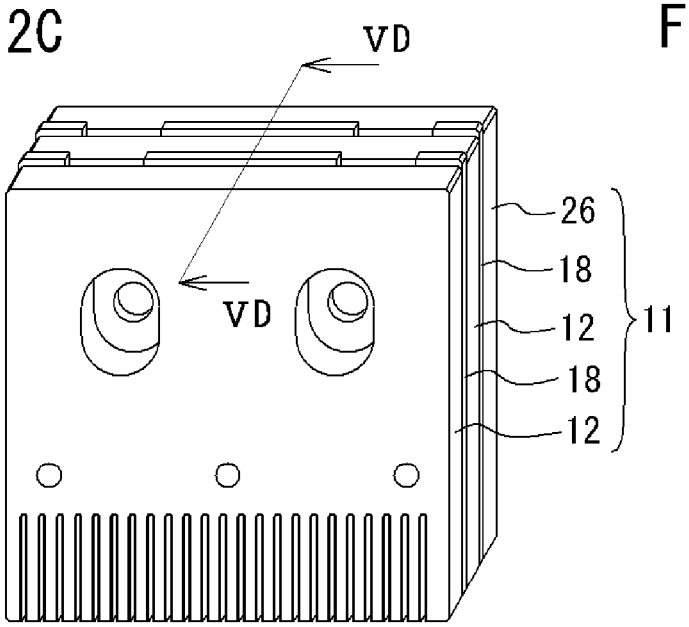
FIG. 2C shows a perspective view of the jig unit of FIG. 2A when it moves.
Figure 2D:
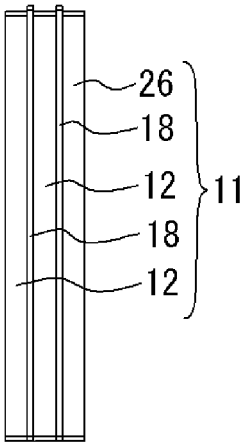
FIG. 2D shows a side view of the jig unit in the state shown in FIG. 2C.

An embodiment of the present invention will be described hereinafter with referring to the drawings. The following embodiment is to exemplify a jig and a press-fitting device being provided with the jig for embodying the technical concept of the present invention, and is not intended to limit the present invention into the above embodiment but can also be equally applicable to other embodiments within the scope of the appended claims.

Embodiment

A jig and a press-fitting device provided with the jig according to the embodiment will be explained with reference to FIGS. 1 to 10. The jig 10 according to the embodiment is, for example, used with being attached to the press-fitting device as shown in FIG. 1, and has a jig unit 11 in which a plurality of plate-shaped bodies are stacked and assembled (refer to FIG. 2). This jig unit 11 is assembled and fixed by making use of at least one fixing member 31. The above portion of the jig unit 11 is provided with an elastic member 32. The press-fitting device 30 to which the jig 10 attaches is used for press-fitting and installing a connector 33 with press-fit terminals 35 to a member to be installed as shown in FIGS. 1 and 3. In this embodiment, the case in which a substrate 42 is used for the member to be installed will be explained.

Figure 3B:
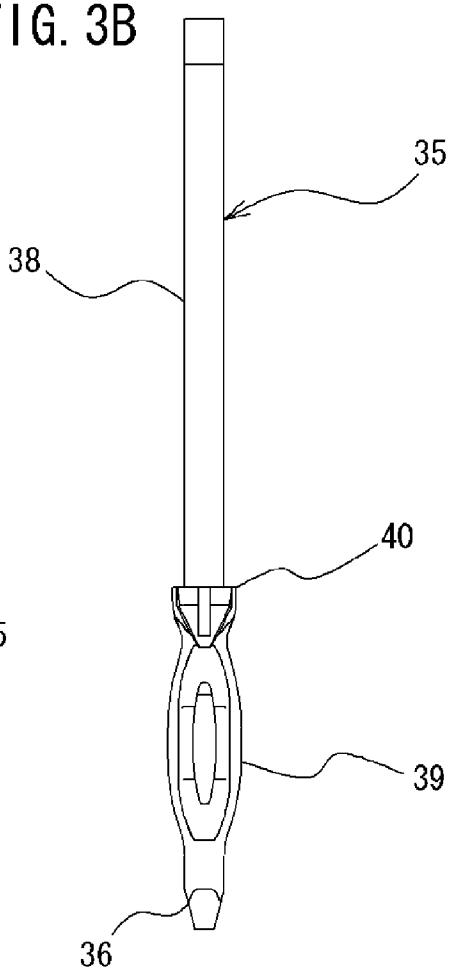
FIG. 3B shows a front view of the press-fit terminals.
Figure 3A:
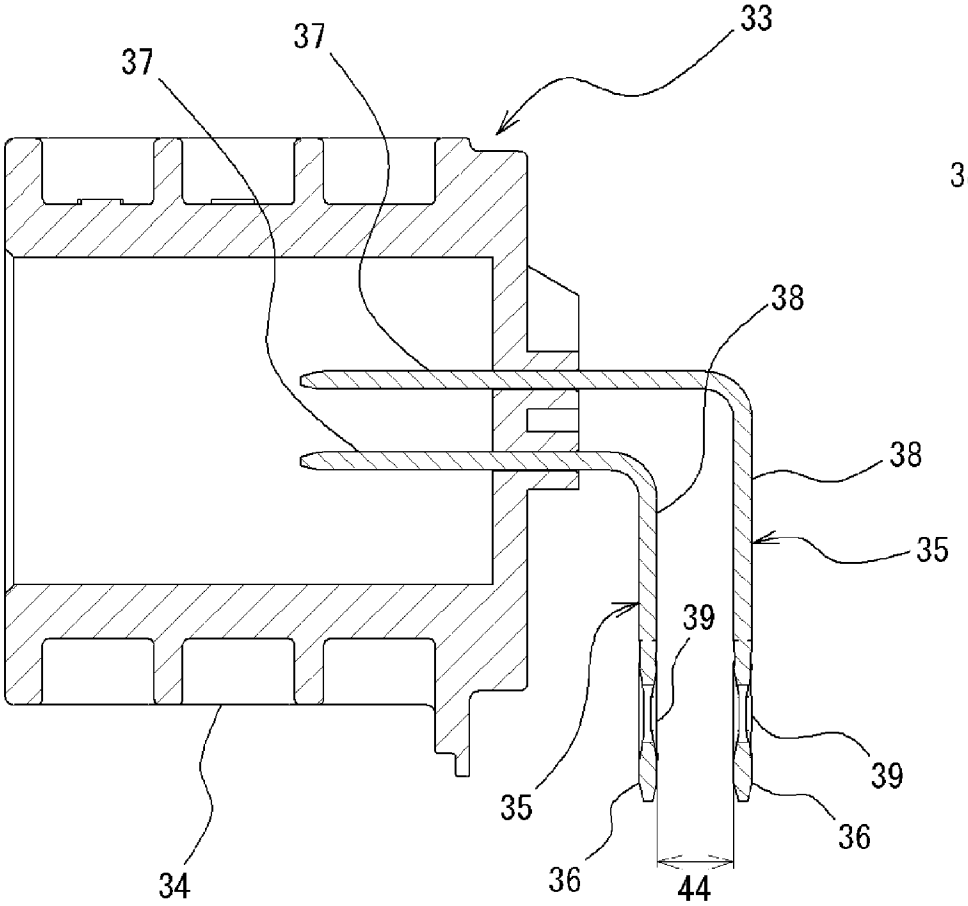
FIG. 3A shows a cross-sectional view of a connector including the press-fit terminals which are to be installed to the substrate by means of the jig of the present embodiment.

Here, the connector 33 having press-fit terminals 35 to be installed to the substrate 42 by making use of the jig 10 according to the embodiment will be explained with reference to FIG. 3. This connector 33 is, as shown in FIG. 3A, formed by providing the press-fit terminals 35 which are bent in L-shape being arranged in two lows in a housing 34 formed as a box-shape. The press-fit terminals 35, as shown FIGS. 3A and 3B, each has a rod-shaped terminal main body 38 formed with a distal portion 36 to be inserted to the substrate 42 at one side, and a connecting portion 37 to be connected to a contact which is provided in a counterpart connector at the other side.

One side of the distal portion 36 of the terminal main body 38 includes a press-fit section 39 to be press-fitted into a through-hole 43 (refer to FIG. 7) formed in the substrate 42, and a shoulder 40 to be pressed by the jig 10 formed above the press-fit section 39. Further, the shoulder 40 and the press-fit section 39 are formed so as to protrude beyond the width of the terminal main body 38 in a direction parallel to the width direction along which the press-fit terminals 35 are arranged in an array.

Any press-fit terminals 35 used in the embodiment can be employed if they have the shoulders 40 to be pressed by the jig 10 and the press-fit sections 39 to be press-fitted into the substrate 42. However, it is preferred to employ press-fit terminals formed of a wire rod. By employing the press-fit terminals formed of the wire rod, breakage and damage of the press-fit terminals can be restricted since the rolling direction of the wire rod at the manufacturing process is in along with the press-fit direction of the press-fit terminals, thus the press-fit terminals can bear larger pressing force during the press-fit process to the substrate than the case employing press-fit terminals formed by punching out a sheet material.

Then, a jig unit 11 constituting the jig 10 according to the embodiment will be explained with reference to FIGS. 2, 4, and 5. The jig unit 11 according to the embodiment is configured by assembling two movable guide members 12, two insertion punches 18, and one rear surface plate body 26. The jig unit 11 thus assembled is fixed by a fixing member 31 such as bolts and is attached and fixed to the press-fitting device 30. The movable guide members 12 and the rear surface plate body 26 are movable upward and downward with respect to the insertion punches 18 when the jig unit 11 is fixed with the fixing member. The each constitution will be explained hereinafter.

Figure 4A:
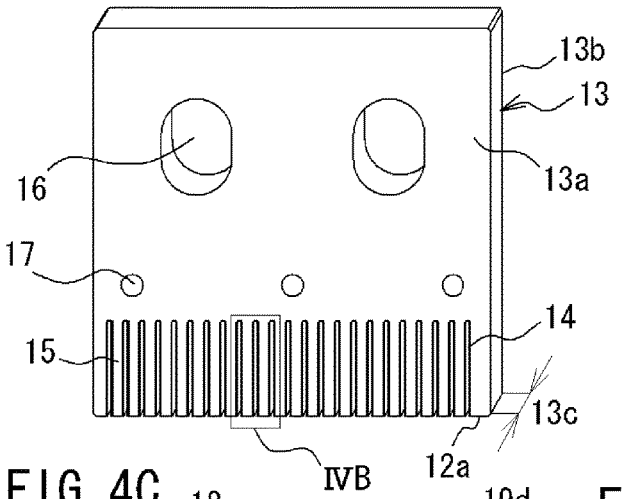
FIG. 4A shows a perspective view of a movable guide member.
Figure 4B:
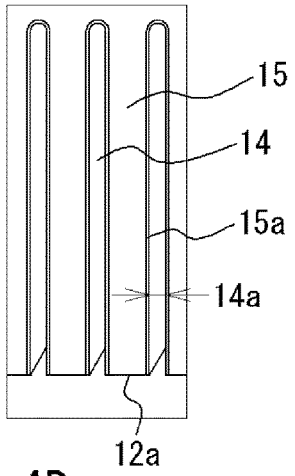
FIG. 4B shows an enlarged view of the IVB-portion of FIG. 4A.

The movable guide member 12 has a guide member main body 13 which is a rectangular shape as shown in FIG. 4A and is formed of plate-shaped body having a predetermined thickness. The guide member main body 13 has a front surface 13*a* and a rear surface 13*b* which have the largest surface areas, and is formed with a plurality of guide grooves 14 penetrating the front surface 13*a* and the rear surface 13*b* and opened at the lowest end. These guide grooves 14 are formed in a portion lower than the center of the guide member main body 13 at the predetermined intervals. First comb-teeth 15 are formed in comb-teeth shape between the each guide grooves 14. The width 14*a* of the gap of the guide groove 14 is formed as a width through which the width 38*a* of the terminal main body 38 of the press-fit terminal 35 can be fitted. Each guide grooves 14 is formed with a taper 15*a* directed inward (refer to FIG. 4B).

Further, the guide member main body 13 is formed with a plurality of, e.g. two, first movable openings 16 of oval shape at an upper portion thereof, and a plurality of, e.g. three, circular first fixing holes 17 at a portion between the first movable openings 16 and the guide grooves 14. These first movable openings 16 and the first fixing holes 17 are used for moving the movable guide member 12 as described later.

Further, the thickness 13*c* of the guide member main body 13 is, as for the movable guide member 12 located between the insertion punches 18, the same or substantially the same thickness so as to correspond to the distance 44 in the front and rear direction between the each rows of the press-fit terminals 35 which are arranged in the housing 34, and to which guide member main body 13 the press-fit terminals 35 of the each rows in the front and rear direction are attached when the press-fit terminals 35 are installed.

The thickness of the guide member main body 13 of the movable guide member 12 placed at the inner most side (the front side) is unnecessary to be formed to have the same thickness corresponding to the distance 44 in the front and rear direction between the each rows of the press-fit terminals 35 but can be formed to have any thickness since the press-fit terminals 35 are placed on only one side of the movable guide member 12. In the connector 33 to which the press-fit terminals 35 formed in L-shape as shown in FIG. 3 are disposed, the terminal main body 38 of the press-fit terminal 35 is bent afterward protruding from the housing 34 of the connector 33. Thus, the thickness of the guide member main body 13 placed at this area is formed as the thickness so that the guide member main body 13 can be placed between the housing 34 and the bent part of the terminal main body 38.

Figure 4C:
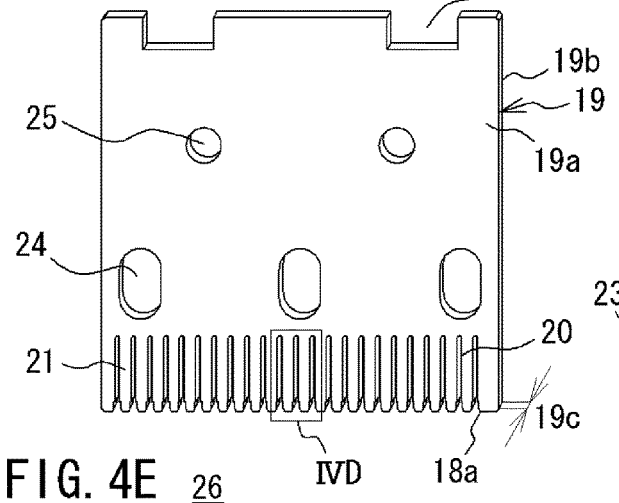
FIG. 4C shows a perspective view of an insertion punch.
Figure 4D:
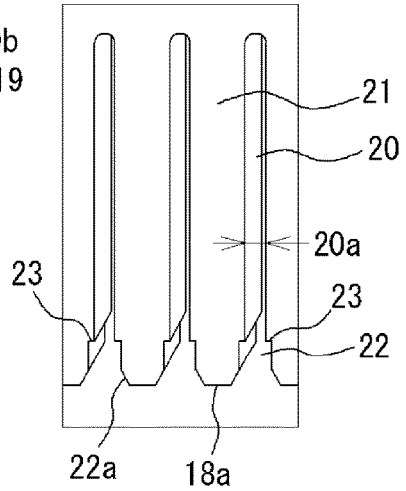
FIG. 4D shows an enlarged view of the TVD-portion of FIG. 4C.

Then, the insertion punch 18 has a punch main body 19 which is a rectangular shape as shown in FIG. 4C and is formed of plate-shaped body having a predetermined thickness. The punch main body 19 has a front surface 19*a* and a rear surface 19*b* which have the largest surface areas, and is formed with a plurality of punch grooves 20 penetrating the front surface 19*a* and the rear surface 19*b* and opened at the lowest end. These punch grooves 20 are formed in the portion lower than the center of the punch main body 19 at the predetermined intervals, and second comb-teeth 21 are formed in comb-teeth shape between the each punch grooves 20.

The width 20*a* of the gap of the punch grooves 20 is formed as a width into which the width 38*a* of the terminal main body 38 of the press-fit terminal 35 can be fitted. Further, shoulder receiving grooves 22 which are wider than the width 20*a* of the punch grooves 20 and into which the shoulders 40 of the press-fit terminals 35 are inserted are formed at the lower side of the punch grooves 20. The boundary portion of the upper part of the shoulder receiving grooves 22 to the punch grooves 20 constitutes pressing sections 23 for pressing the shoulders 40. The each shoulder receiving grooves 22 has tapers 22*a* at its lower end so as to smoothly receive the shoulder 40 and so as not to touch the press-fit section 39 formed at the lower side of the shoulder 40 of the press-fit terminal 35 (refer to FIG. 4D). The length of the shoulder receiving grooves 22 is associated with the depth of installing the press-fit terminals 35 to the substrate, therefore, the length of the shoulder receiving grooves 22 is formed in a short dimension in the case that the press-fit terminals 35 are deeply installed to the substrate while the length of the shoulder receiving grooves 22 is formed in a long dimension in the case that the press-fit terminals 35 are shallowly installed to the substrate.

The punch main body 19 is formed with a plurality of, e.g. three, circular second fixing holes 25 at an upper portion thereof, and a plurality of, e.g. two, second movable openings 24 of oval shape at a portion between the second fixing holes 25 and the punch grooves 20. These second fixing holes 25 and the second movable openings 24 are used for moving the movable guide members 12 as described later.

The thickness of the punch main body 19 is formed as a thickness 19*c* which is the same or substantially the same thickness corresponding to the horizontal length perpendicular to the widthwise direction of the terminal main body 38 of the press-fit terminal 35 so as to receive the terminal main body 38 when the terminal main body 38 is fitted into the punch groove 20. The punch main body 19 has cut-out portions 19*d* on which portions elastic members 32 are disposed. The guide grooves 14 of the movable guide members 12 and the punch grooves 20 of the insertion punches 18 are formed so as to correspond each other at the state that the movable guide members 12 and the insertion punches 18 are assembled together and so that the each guide grooves 14 and the punch grooves 20 formed at the corresponded locations are communicated each other.

Figure 4E:
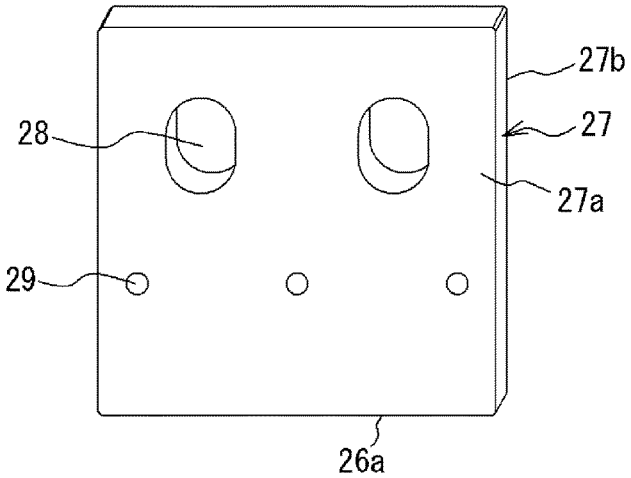
FIG. 4E shows a perspective view of a rear surface plate body.
Figure 5A:
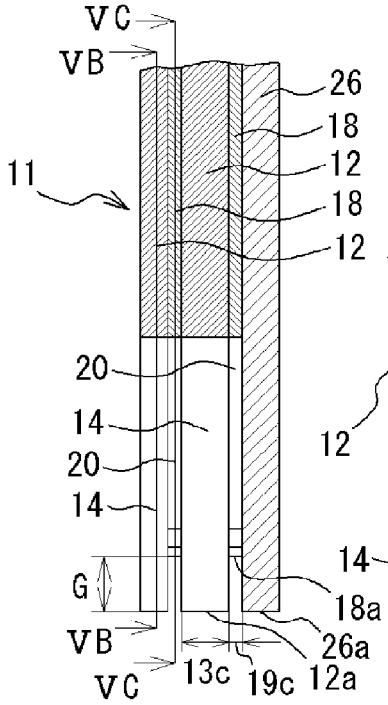
FIG. 5A shows a cross-sectional view at VA-VA line of FIG. 2A.
Figure 5B:
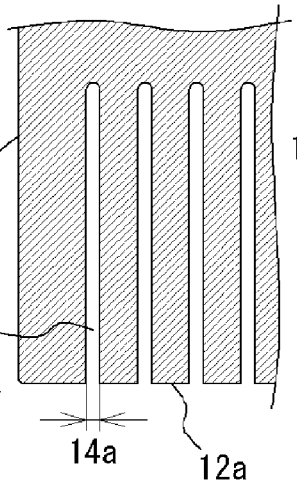
FIG. 5B shows a cross-sectional view at VB-VB line of FIG. 5A.
Figure 5C:
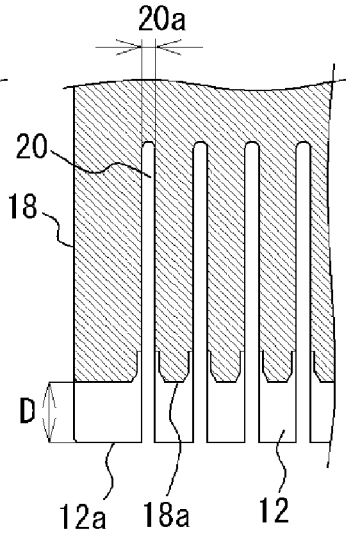
FIG. 5C shows a cross-sectional view at VC-VC line of FIG. 5A.
Figure 5D:
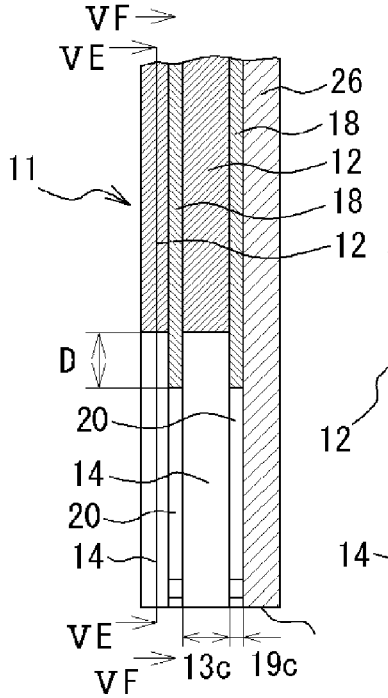
FIG. 5D shows a cross-sectional view at VD-VD line of FIG. 2B.
Figure 5E:
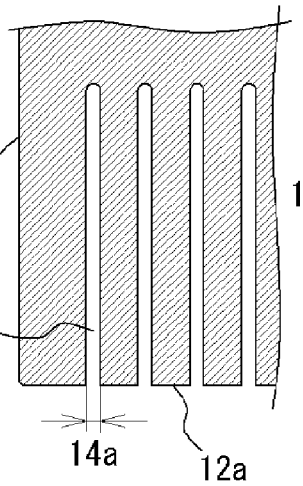
FIG. 5E shows a cross-sectional view at VE-VE line of FIG. 5D.
Figure 5F:
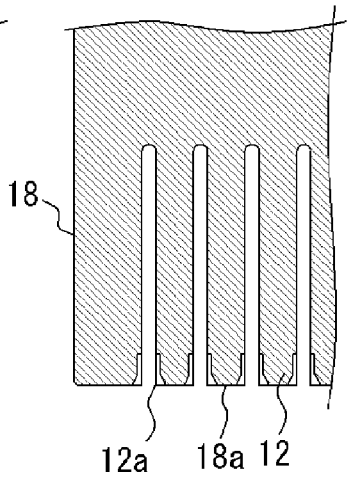
FIG. 5F shows a cross-sectional view at VF-VF line of FIG. 5D.

The rear surface plate body 26 has a plate main body 27 which is a rectangular shape as shown in FIG. 4E and is formed of plate-shaped body having a predetermined thickness, and has a front surface 27*a* and a rear surface 27*b* which have the largest surface areas. The plate main body 27 is formed with a plurality of, e.g. two, third movable openings 28 of oval shape at an upper portion thereof, and a plurality of, e.g. three, circular third fixing holes 29 at a portion between the third movable openings 28 and the lower end 26*a*. These third movable openings 28 and the third fixing holes 29 are used for moving the movable guide members 12 as described later. The plate main body 27 of the rear surface plate body 26 is formed in any thickness and can be manufactured by making use of plate-shaped body for manufacturing the movable guide members or the insertion punches.

The first movable openings 16 of the movable guide member 12, second fixing holes 25 of the insertion punch 18, and the third movable openings 28 of the rear surface plate body 26 are, when the jig unit 11 is assembled, formed so as to correspond each other, and the first fixing holes 17 of the movable guide member 12, the second movable openings 24 of the insertion punch 18, and the third fixing holes 29 of the rear surface plate body 26 are formed so as to correspond each other.

Next, the assembling process of the jig will be explained hereinafter. The jig unit 11 constituting the jig 10 is configured by, as shown in FIGS. 2 and 5, alternatively arranging the movable guide members 12 and the insertion punches 18. In this moment, a movable guide member 12 is placed on the front side from which the press-fit terminals 35 are inserted and an insertion punch 18 is placed on the opposite rear side. The rear surface plate body 26 is placed on the rear side of one insertion punch 18 which is placed at the outermost rear side. Therefore, the positioning of the rear surface plate body 26 is carried out by abutting the press-fit terminals to the rear surface plate body 26 when the press-fit terminals 35 are inserted.

In the jig unit 11, the position of the lower ends 18*a* of the insertion punches 18 are located upper than the lower ends 12*a* of the movable guide members 12 and the lower end 26*a* of the rear surface plate body 26 with the gap G (refer to FIGS. 2A, 2B, and 5A to 5C). Therefore, the predetermined gap G is formed between the lower ends 12*a*, 26*a* of the movable guide members 12 and the rear surface plate body 26 and the lower end 18*a* of the insertion punches 18. The movable guide members 12 and the rear surface plate body 26 can be moved upward with respect to the insertion punches 18 since the gap G is formed, and the distance of the gap G is the movable range (refer to FIGS. 2C, 2D, and FIGS. 5D to 5F).

The jig unit 11 thus assembled is fixed by the fixing member 31 and is attached to the press-fitting device 30 as shown in FIG. 1 with the elastic member 32 disposed on the above portion of the jig unit 11, thus the jig 10 can be used. The assembled jig unit 11 is fixed and disposed on the press-fitting device 30 so that the first fixing holes 17, the second movable openings 24, and the third fixing holes 29 of the each lower sides of the movable guide members 12, the insertion punches 18, and the rear surface plate body 26 are fixed by the fixing members 31 such as bolts, and that the first movable openings 16, the second fixing holes 25, and the third movable openings 28 of the each upper sides of the movable guide members 12, the insertion punches 18, the rear surface plate body 26 are fixed to the press-fitting device 30 by the fixing members 31 such as bolts.

In this way, the insertion punches 18 are fixed to the press-fitting device 30 while the movable guide members 12 and the rear surface plate body 26 are fixed together. Further, the movable guide members 12 and the rear surface plate body 26 can move upward and downward with respect to the insertion punches 18 fixed to the press-fitting device 30 since the bolts penetrating through the each first movable openings 16, third movable openings 28, and the second movable openings 24 which are formed in oval shape are moved. The movable guide members 12 and the rear surface plate body 26 are disposed on the press-fitting device 30 with the state of being pressed downward by means of the elastic member 32 which are provided on the above portion of the jig unit 11. The movable guide members 12 and the rear surface plate body 26 can move upward with respect to the press-fitting device 30 and the fixed-insertion punches 18 by the distance D corresponding to the distance of the insertion punches 18 being pressed downward.

Then, the process for disposing press-fit terminals 35 to the jig 10 and installing to the substrate 42 will be explained with reference to FIGS. 6 to 10. The jig 10 according to the embodiment is used with being attached to the press-fitting device 30 as shown in FIG. 1. The press-fit terminals 35 are attached in the connector 33 as shown in FIG. 3, and the connector 33 is also attached to the press-fitting device 30 as shown in FIG. 1. In FIGS. 6 to 10, a portion including the jig of the press-fitting device is shown in an enlarged manner.

Figures 6A, 6B, 6C:
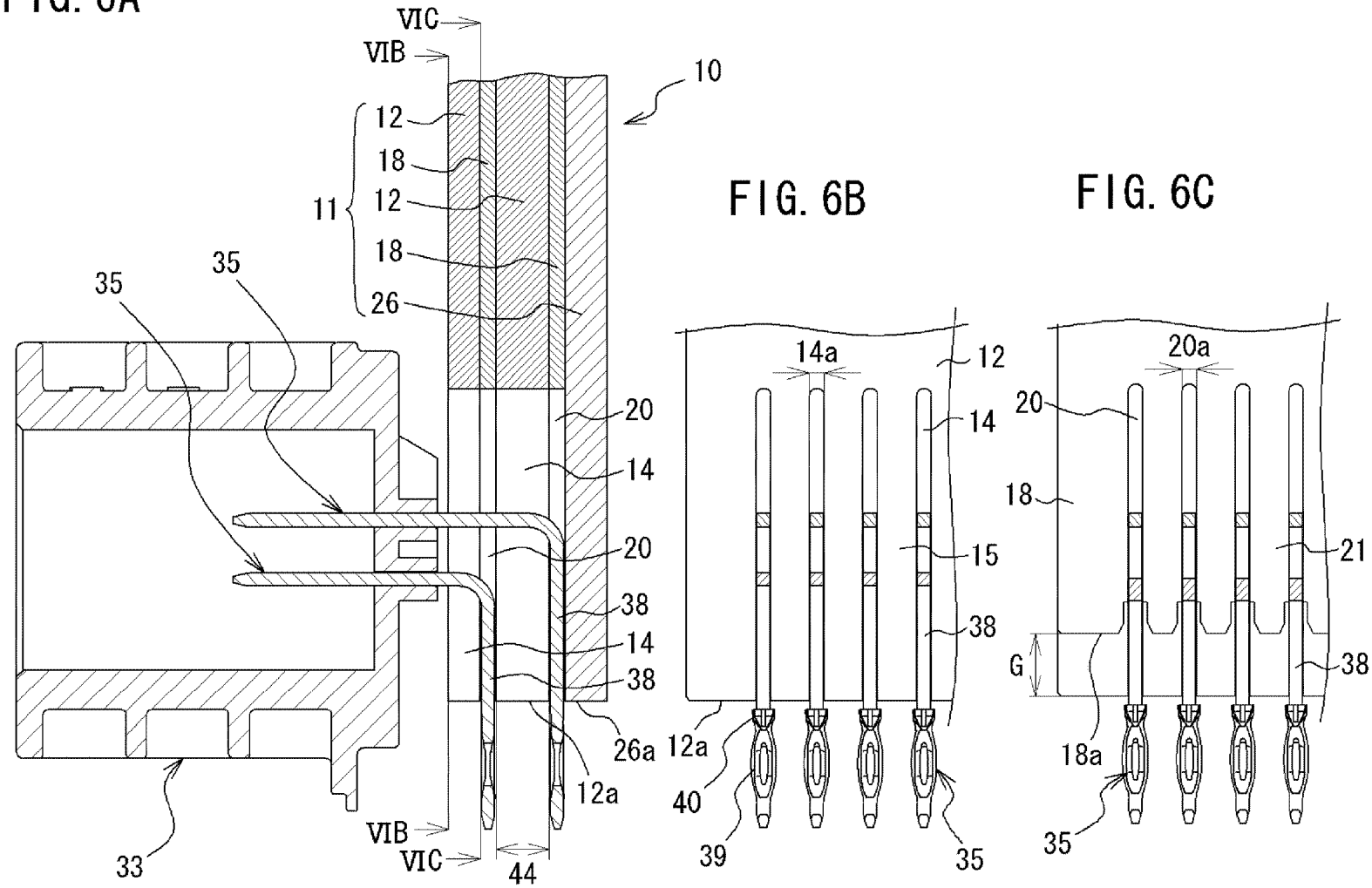
FIG. 6A shows a cross-sectional view of the state in which the press-fit terminals are inserted to the jig.
FIG. 6B shows a cross-sectional view at VIB-VIB line of FIG. 6A.
FIG. 6C shows a cross-sectional view at VIC-VIC line of FIG. 6A.

In order to dispose the press-fit terminals 35 to jig 10, the press-fit terminals 35 are moved horizontally rearward and inserted from the front side face of the jig 10 as shown in FIG. 6A. Here, on the side from which the press-fit terminals 35 of the jig 10 are inserted is formed with the guide grooves 14 of the movable guide members 12 and the punch grooves 20 of the insertion punches 18 which constitute the jig unit 11. And the upper portion of the terminal main bodies 38 of the press-fit terminals 35 upper than the shoulders 40 are inserted into the punch grooves 20 and the guide grooves 14 (refer to FIGS. 6B and 6C).

The guide grooves 14 and the punch grooves 20 are formed and arranged so as to correspond with each other, thus they are penetrated throuthout the rear surface plate body 26 (refer to FIG. 6A). The widths 14*a*, 20*a* of the gaps formed on the guide grooves 14 and the punch grooves 20 are formed as the width through which the terminal main body 38 can be fitted, thus the press-fit terminals 35 can be set vertically with adjusting the deviation in the right and left direction i.e. widthwise direction when viewing from the front by fitting the upper portion of the terminal main bodies 38 upper than the shoulders 40 through the guide grooves 14 and the punch grooves 20 (refer to FIGS. 6B and 6C).

The insertion is implemented until the press-fit terminals 35 placed on the outermost rear side abut to the rear surface plate body 26. At this moment, since the press-fit terminals 35 placed on the outer most side of the connector 33 abut to the rear surface plate body 26, the one portion of the terminal main bodies 38 of each press-fit terminals 35 including the shoulder 40, press-fit section 39, and the distal portion 36 are placed at the position to which the insertion punches 18 are placed. The movable guide member 12 is placed between the front low and the rear low of the each press-fit terminals 35 which are arranged in array.

Afterward, the jig 10 is moved in the vertical direction to set the press-fit terminals 35 into the jig. This insertion is implemented by firstly moving the jig downward in the vertical direction and thus the insertion punches 18 moves downward, the shoulders 40 of the press-fit terminals 35 are fitted into the shoulder receiving grooves 22 of the insertion punches 18 as shown in FIG. 7A, and the pressing sections 23 of the upper part of the shoulder receiving grooves 22 abut against the upper part of the shoulder 40 (refer to FIGS. 7C, 8B). Further, as the insertion punches 18 move downward, the side surfaces of the terminal main bodies 38 are guided by the punch grooves 20. The shoulder receiving grooves 22 are formed as a length so that at least whole shoulder 40 can be fitted.

Figure 7B:
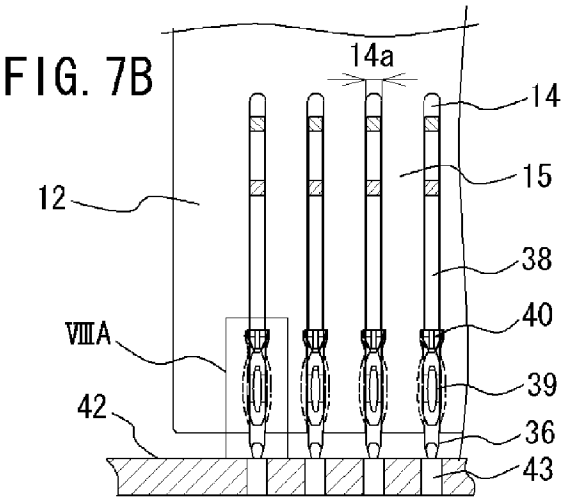
FIG. 7B shows a cross-sectional view at VIIB-VIIB line of FIG. 7A.
Figure 7C:
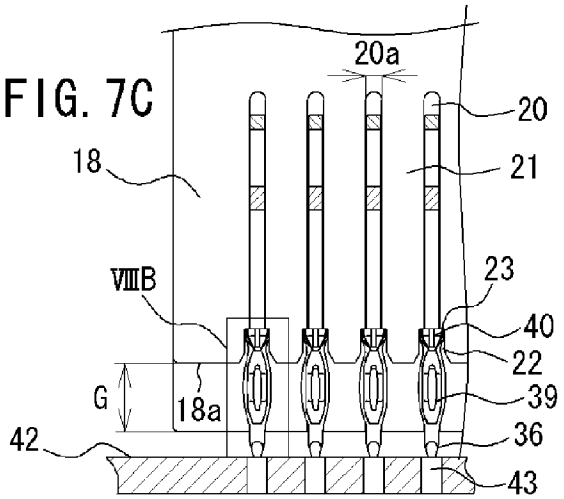
FIG. 7C shows a cross-sectional view at VIIC-VIIC line of FIG. 7A.
Figure 7A:
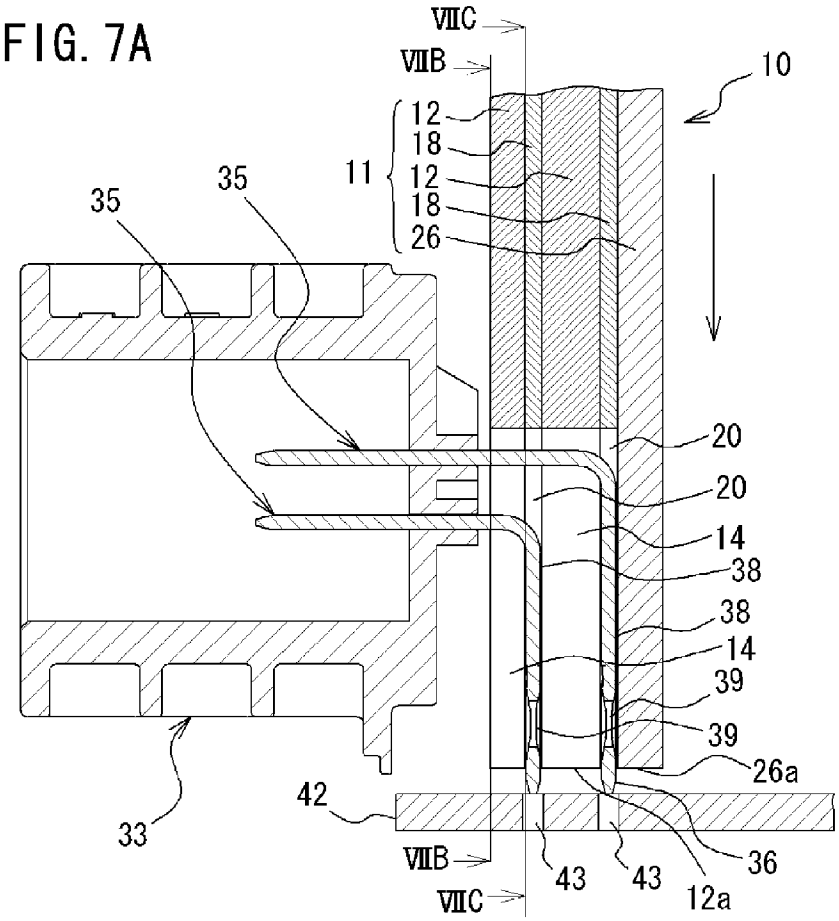
FIG. 7A shows a cross-sectional view of the state continuing from FIG. 6A in which the press-fit terminals are inserted to the jig.
Figure 8B:
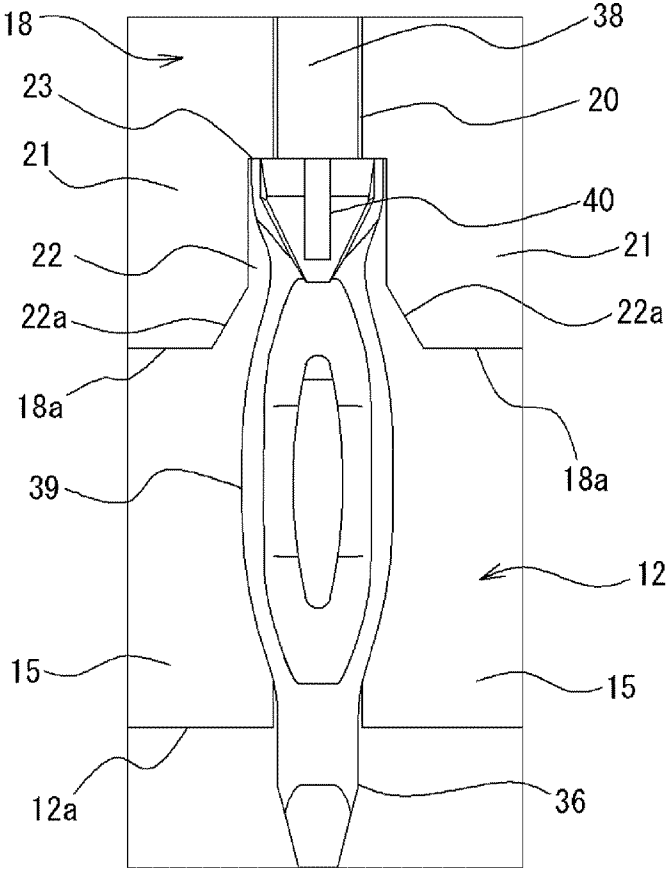
FIG. 8B shows an enlarged view of the VIIC-portion of FIG. 7C.
Figure 8A:
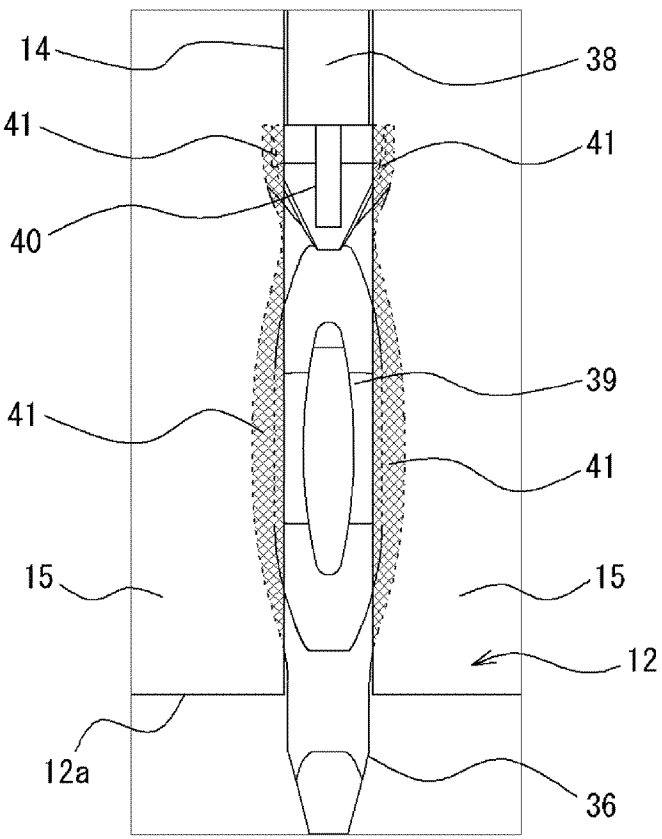
FIG. 8A shows an enlarged view of the VIIA-portion of FIG. 7B.
Figure 9B:
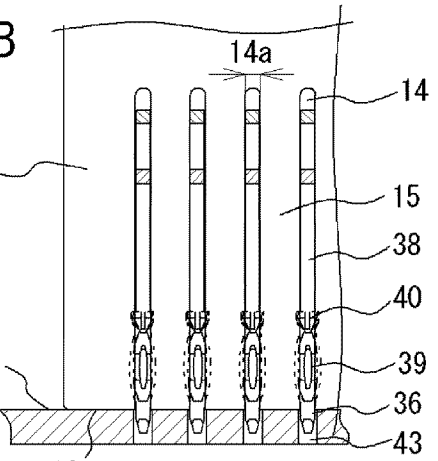
FIG. 9B shows a cross-sectional view at IXB-IXB line of FIG. 9A.
Figure 9C:
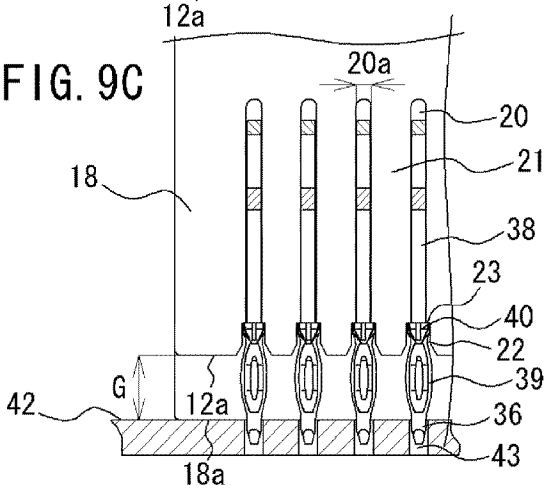
FIG. 9C shows a cross-sectional view at IXC-IXC line of FIG. 9A.
Figure 9A:
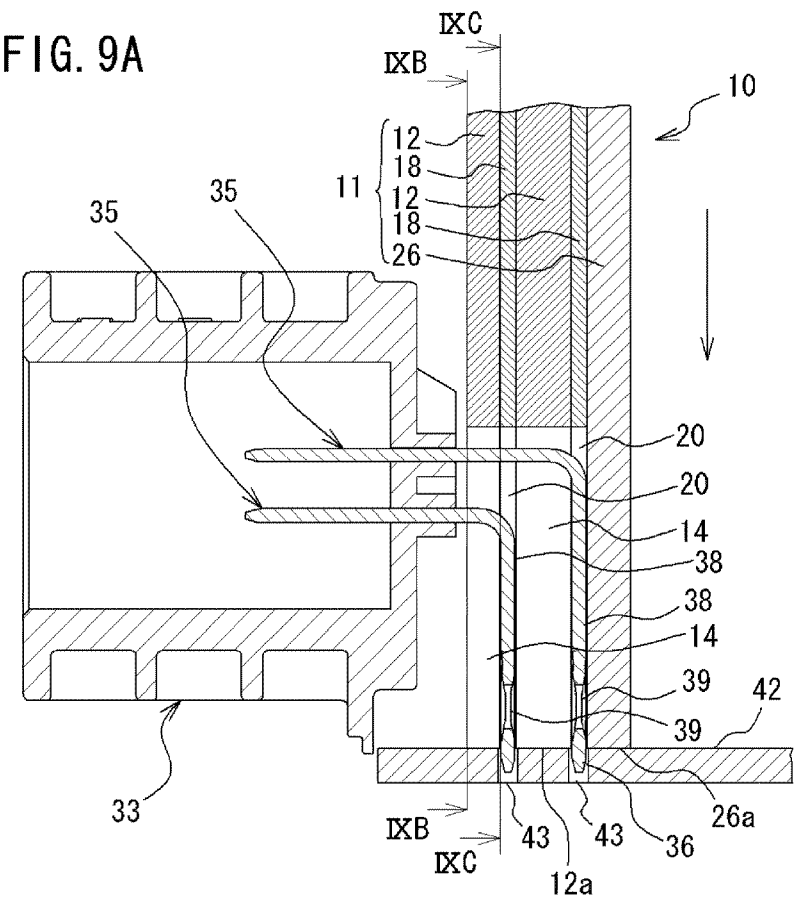
FIG. 9A shows a cross-sectional view of the state continuing from FIG. 7A in which the press-fit terminals are inserted to the jig.

The movable guide members 12 are moved downward beyond the shoulders 40 and the press-fit sections 39 of the press-fit terminals 35 by moving the jig 10 downward in the vertical direction (refer to FIG. 7B). At this moment, the portions 41 which extend beyond the shoulders 40 and the width 38*a* of the terminal main bodies 38 of the press-fit sections 39 extend beyond the guide grooves 14 since the width 14*a* of the guide grooves 14 is formed as almost the same width as the width 38*a* of the terminal main bodies 38, thus the front and the rear sides of the portions 41 which extend out abut to the first comb-teeth 15 formed between the each guide grooves 14. The shoulders 40 and the press-fit sections 39 are guided with the movable guide members 12 by this abutment, thus the deviation in the front and rear direction viewing from the side can be adjusted to set the press-fit terminals 35 uprightly. The disposing the press-fit terminals 35 to the jig 10 is thus implemented.

Thereafter, the press-fit terminals 35 are installed to the substrate 42. This installation process is implemented by, firstly shown in FIG. 9A, moving the press-fit terminals 35 downward along with the jig in the vertical direction, inserting the distal portions 36 of the press-fit terminals 35 into the through-holes 43, and abutting the lower ends 12*a*, 26*a* of the movable guide members 12 and the rear surface plate body 26 to the substrate 42 (refer to FIG. 9B). At this moment, the lower end 18*a* of the insertion punches 18 are located apart from the substrate 42 by the gap G, between which gap G the press-fit sections 39 of the press-fit terminals 35 are placed (refer to FIG. 9C).

Figure 10B:
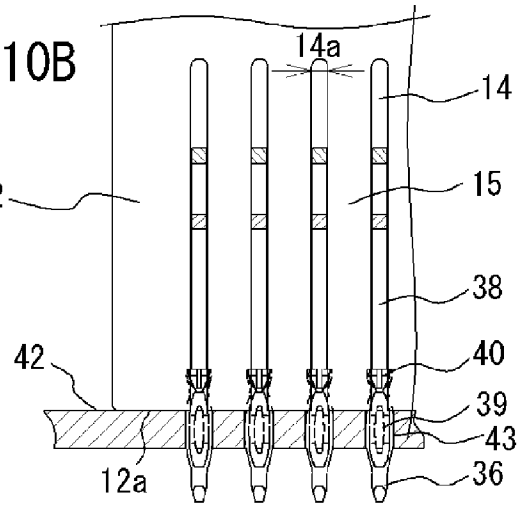
FIG. 10B shows a cross-sectional view at XB-XB line of FIG. 10A.
Figure 10C:
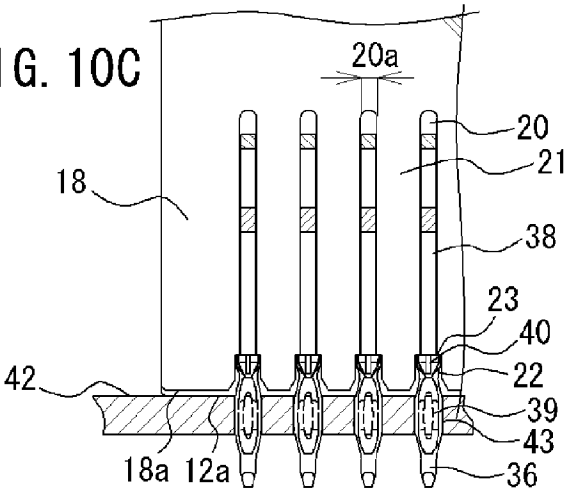
FIG. 10C shows a cross-sectional view at XC-XC line of FIG. 10A.
Figure 10A:
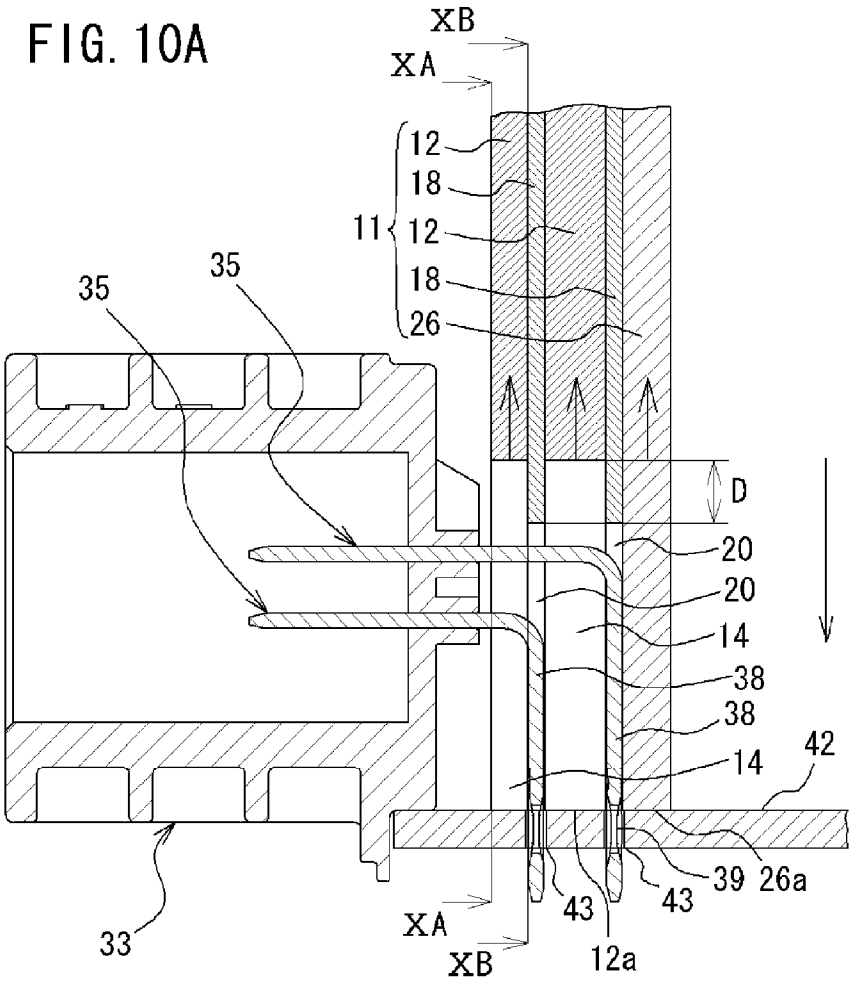
FIG. 10A shows a cross-sectional view of the state continuing from FIG. 9A in which the press-fit terminals are inserted to the jig.

Afterward, by moving the jig 10 downward as shown FIG. 10A, the insertion punches 18 move downward by the gap G, thus the shoulders 40 are pressed by the pressing sections 23 of the insertion punches 18 and the press-fit sections 39 are press-fitted into the through-holes 43. At this moment, side surfaces of the terminal main bodies 38 of the press-fit terminals 35 are guided by the punch grooves 20, and the both sides of the shoulders 40 are guided by the shoulder receiving grooves 22 (refer to FIG. 10C), Further, the movable guide members 12 and the rear surface plate body 26 are restricted to move downward by the substrate 42, thus they move upward with respect to the insertion punches 18 by the distance D which corresponds to the distance of which the insertion punches 18 are pressed downward (refer to FIGS. 10A and 10B). By this upward relative movement, when the press-fit sections 39 are press-fitted, the portions 41 which extend out beyond the shoulders 40 and the guide grooves 14 of the press-fit sections 39 are also guided by the first comb-teeth 15 of the movable guide members 12.

Therefore, according to the jig 10 of the embodiment, buckling can be restricted when the press-fit terminals 35 are press-fitted to the substrate 42 since the press-fit terminals 35 are guided by the punch grooves 20 and the shoulder receiving grooves 22 of the insertion punches 18 at its right and left direction i.e. widthwise direction and also guided by the first comb-teeth 15 of the movable guide members 12 at its front and rear direction. Especially, the press-fit terminals 35 are guided by the movable guide members 12 when the press-fit sections 39 are press-fitted, thus the buckling can be further restricted.

The rear surface plate body 26 guides the shoulders 40 and the all the entire rear surface of the press-fit sections 39 when the rear surface plate body 26 relatively moves upward with respect to the insertion punches 18, the buckling can be restricted also by the rear surface plate body 26. At this moment, since the movable guide members 12 and the rear surface plate body 26 relatively move upward with respect to the insertion punches 18, the elastic member 32 disposed on the above portion of the jig 10 is compressed and the elastic force is accumulated. As explained above, installation of the press-fit terminals 35 to the substrate 42 is completed.

As the jig 10 moves upward, the movable guide members 12 and the rear surface plate body 26 which have already relatively moved upward are pressed downward and placed back to the original position by the elastic force of the elastic member 32 disposed on the jig 10. Therefore, the installation can be repeatedly conducted by the press-fitting device 30 which is provided with the jig 10, thus the installation process can be enhanced.

In the above embodiment, the jig unit constituting the jig is explained as being configured by assembling two movable guide members, two insertion punches, and one rear surface plate body. However, the invention is not limited to this, and the number of the movable guide members and the insertion punches can be changed in accordance with the number of the low of the press-fit terminals disposed on the connector to be installed. It can be applied to and corresponded to the many connectors by assembling the movable guide members, insertion punches, and the rear surface plated body. Therefore, the manufacturing cost for the jig can be reduced since there is no need for manufacturing a jig for a specific connector.

In the embodiment, the case in which the jig is attached to the press-fitting device and used is explained. However, the invention is not limited to this, the jig of the present invention can be used in any devices for installing the press-fit terminals, in general.

The invention claimed is:

1. A jig for guiding insertions of a plurality of press-fit terminals, comprising:

a jig unit for installing the plurality of press-fit terminals which have shoulders and press-fit sections being formed wider than a width of a terminal main body and are arranged in at least one row, the jig unit being assembled by a plurality of plate-shaped bodies made of metal, wherein the jig unit comprises:

at least one sheet of movable guide member being formed in a comb-teeth shape having a plurality of guide grooves extending along a vertical direction into which the terminal main bodies can be fitted, at least one sheet of insertion punch being formed in a comb-teeth shape having a plurality of punch grooves extending along the vertical direction corresponding to the guide grooves and being formed with pressing sections at the punch grooves for pressing the shoulders of the press-fit terminals, and one sheet of rear surface plate body, wherein the at least one sheet of movable guide member and the at least one sheet of insertion punch are alternately disposed along a front and a rear direction orthogonal to the vertical direction so that each surface of the at least of one sheet of movable guide member and the at least one sheet of insertion punch is faced to each other, wherein the movable guide member and the rear surface plate body are attached so as to be upwardly and downwardly movable with respect to the insertion punch, and wherein when the press-fit terminals are installed to a member to be installed, and during the press-fit sections are adapted to be press fitted to the member to be installed by the insertion punch, the movable guide member and the rear surface plate body move upward with respect to the insertion punch after the lower ends of the movable guide member and the insertion punch are adapted to abut to the member to be installed.

2. The jig according to claim 1, wherein the jig unit is assembled so that the movable guide members and the insertion punches are alternatively disposed wherein the movable guide member is disposed at a side from which the press-fit terminals are inserted while the rear surface plate body is disposed at an opposite side to the side from which the press-fit terminals are inserted; and the position of lower ends of the insertion punches are placed above with respect to lower ends of the movable guide members and the rear surface plated body.

3. The jig according to claim 2, wherein the movable guide member is formed with at least one first movable opening of oval shape at an upper portion of the movable guide member and at least one first fixing hole at a lower portion of the movable guide member;

the insertion punch is formed with at least one second fixing hole at an upper portion of the insertion punch and at least one second movable opening of oval shape at a lower portion of the insertion punch;

rear surface plate body is formed with at least one third movable opening of oval shape at an upper portion of the rear surface plate body and at least one third fixing hole at a lower portion of the rear surface plate body;

the first movable opening, the second fixing hole, and the third movable opening are inserted with one identical fixing member while the first fixing hole, the second movable hole, and the third fixing hole are inserted with another one identical fixing member.

4. The jig according to claim 1, wherein an elastic member for downwardly pressing the movable guide member and the rear surface plate body is provided on upper side of the jig unit.

5. The jig according to claim 1, wherein when the jig unit is adapted to be attached to the press-fit terminals, at least one portion of the terminal main body is adapted to be inserted to the jig unit from a side where the movable guide member is placed outside of the terminal main body, an upper portion of the terminal main body above the shoulders of the press-fit terminals is adapted to be inserted through the guide groove of the movable guide member and through the punch groove of the insertion punch, and at least one portion of the terminal main body above the shoulders of the press-fit terminals is placed inside the punch groove when the press fit terminals being provided on an outermost side adapted to abut to the rear surface plate body; and by moving the jig unit downward, both side surfaces of the terminal main body in a widthwise direction of which the press-fit terminals are arranged, are guided by the punch groove, the pressing section of the punch groove is adapted to abut against the upper portion of the shoulders of the press-fit terminals, the shoulders of the press-fit terminal to which a comb-teeth portion of the insertion punch is being provided on both sides of the guide groove of the movable guide member and is adapted to abut a portion of the press-fit section of the press-fit terminal being wider than the guide groove, and a portion of the press-fit terminal to which the rear surface plate body abut are guided.

6. The jig according to claim 5, wherein when the jig unit is moved downward and the press-fit terminals are press-fitted to the member to be installed, the downward movement of the movable guide member and the rear surface plate body is restricted by the abutment of the lower ends of the movable guide member and the rear surface plate body against the member to be installed, thereafter, by continually moving the jig unit downward, the insertion punch is moved downward and the shoulders of the press-fit terminals are pressed by the pressing section of the punch groove;

thereby the press-fit section of the press-fit terminals is press-fitted to the member to be installed, and the shoulders and the portion of the press-fit terminals being wider than the guide groove and the portion of the press-fit terminals to which the rear surface plate body abuts, are guided by the comb-teeth portion of the movable guide member.

7. The jig according to claim 6, wherein the upper portion of the jig unit is provided with an elastic member, the elastic member is elastically deformed by an upward relative movement of the movable guide member and the rear surface plate body with respect to the insertion punches when the jig unit is moved downward, and after completion of installation of the press-fit terminals to the member to be installed and when the jig unit is moved upward, the elastic deformation of the elastic member is released and the movable guide member and the rear surface plate body are pressed downward by the elastic force of the elastic member, thereby the movable guide member and the rear surface plate body are placed at a predetermined position.

8. A press-fitting device for guiding insertions of press-fit terminals, comprising a jig, the jig including a jig unit for installing a plurality of press-fit terminals which have shoulders and press-fit sections being formed wider than a width of a terminal main body and are arranged in at least one row, the jig unit being assembled by a plurality of plate-shaped bodies made of metal, wherein the jig unit comprises:

at least one sheet of movable guide member being formed in a comb-teeth shape having a plurality of guide grooves extending along a vertical direction into which the terminal main bodies can be fitted, at least one sheet of insertion punch being formed in a comb-teeth shape having a plurality of punch grooves corresponding to the guide grooves extending along the vertical direction and being formed with pressing sections at the punch grooves for pressing the shoulders of the press-fit terminals, and one sheet of rear surface plate body, wherein the at least one sheet of movable guide member and the at least one sheet of insertion punch are alternately disposed along a front and a rear direction orthogonal to the vertical direction so that each surface of the at least of one sheet of movable guide member and the at least one sheet of insertion punch is faced to each other, wherein the movable guide member and the rear surface plate body are attached so as to be upwardly and downwardly movable with respect to the insertion punch, and wherein when the press-fit terminals are installed to a member to be installed, and during the press-fit sections are adapted to be press fitted to the member to be installed by the insertion punch, the movable guide member and the rear surface plate body move upward with respect to the insertion punch after the lower ends of the movable guide member and the insertion punch are adapted to abut to the member to be installed.

* * * * *